United States Patent [19]

Gagne

[11] Patent Number: 4,706,939

[45] Date of Patent: Nov. 17, 1987

[54] FIRE HYDRANT HOIST

[76] Inventor: Claude Gagne, 667 rue Norvége, Apt. 5, Sainte-Foy, Quebec, Canada, G1X 3G5

[21] Appl. No.: 893,360

[22] Filed: Aug. 5, 1986

[51] Int. Cl.[4] ..... B66D 1/04; B66D 1/36

[52] U.S. Cl. ..... 254/332; 254/338

[58] Field of Search ..... 254/332, 334, 338, 357, 254/376, 380, 219, 223, 224, 226, 227

[56] References Cited

U.S. PATENT DOCUMENTS

| | | | |
|---|---|---|---|
| 462,875 | 11/1891 | Huff | 254/334 X |
| 618,230 | 1/1899 | Miller | 254/357 X |
| 660,272 | 10/1900 | Herzog et al. | 254/376 X |
| 3,181,707 | 5/1965 | Janssen | 254/338 X |
| 3,991,978 | 11/1976 | Jones | 254/335 |
| 4,239,188 | 12/1980 | Hobbs | 254/380 X |
| 4,296,916 | 10/1981 | Jewett | 254/380 |
| 4,511,122 | 4/1985 | Svendsen | 254/332 |
| 4,597,562 | 7/1986 | Joyce | 254/334 |

FOREIGN PATENT DOCUMENTS

| | | | |
|---|---|---|---|
| 1932865 | 1/1971 | Fed. Rep. of Germany | 254/334 |

*Primary Examiner*—Stuart S. Levy
*Assistant Examiner*—Joseph J. Hail, III

[57] ABSTRACT

There is disclosed a hoist for lifting a fire hydrant from its underlying upright feeding pipe. The hoist comprises an inverted L-shaped post with a manually-operated cable winch. The post is supported on a semi-circular base collar which fits the top coupling flange of the feeding pipe. This collar has top and bottom inwardly extending flanges for embracing the above-noted coupling flange. A toggle lever clamp locks the collar in position. The collar has a lateral extension on which the post is mounted to clear the fire hydrant. The post can be rotated to swing the fire hydrant laterally of the feeding pipe to facilitate access to the interior of the same. A latching mechanism latches the post in any of a plurality of rotated positions.

6 Claims, 4 Drawing Figures

FIRE HYDRANT HOIST

FIELD OF THE INVENTION

The present invention relates to a hoist for use in the maintenance of fire hydrants.

BACKGROUND OF THE INVENTION

Fire hydrants require regular maintenance and must also be repaired. They are frequently installed on an even ground, or on lawns. For their repair or maintenance, the fire hydrant head must be lifted off the underlying upright feeding pipe which normally extends up to ground level. This is necessary in order to gain access to the valve normally installed in the pipe below the ground freezing level. Handling the fire hydrant head by hand is a tiresome operation which can freqently lead to injuries, due to the weight of these heads.

It is not always possible to back up a truck equipped with a hoist to the site of the hydrant, because of damage to the lawns or surrounding area. Moreover, such a truck is expensive to acquire and to operate. Hoists of the tripod type would also damage lawns.

OBJECTS OF THE INVENTION

Accordingly, the main object of the invention is to provide a hoist for fire hydrant heads, which obviates the above-noted disadvantages in that it is of light weight construction; easily transportable by hand; of inexpensive construction and which is characterized by the fact that it is directly mounted on the hydrant head feeding pipe, thereby obviating the possibility of damage to lawn surrounding the hydrant.

Another object of the invention is to provide a hoist of the character described, by means of which the fire hydrant head can be swung to the side of the feeding pipe to gain access to the interior of the latter.

Another object of the invention is to provide a hoist of the character described, which can be easily manipulated by one man.

SUMMARY OF THE INVENTION

The fire hydrant hoist of the invention is for use on fire hydrants of the type in which both the head and the upright feeding pipe have mating coupling flanges. The hoist comprises a base, in the form of a semi-circular collar, fitting around the top coupling flange of the feeding pipe; a clamping means to removably clamp the collar in operative position; the collar having inwardly-extending upper and lower flanges adapted to embrace the top coupling flange of the feeding pipe, the collar further having a lateral extension on which an inverted L-shaped post is supported with the post carrying a winch and cable system for hoisting the fire hydrant head. The post is preferably rotatably mounted on the extension and latching means are provided to angularly latch the post in a plurality of selected angular positions.

DETAILED DESCRIPTION OF THE INVENTION

Figure 1:
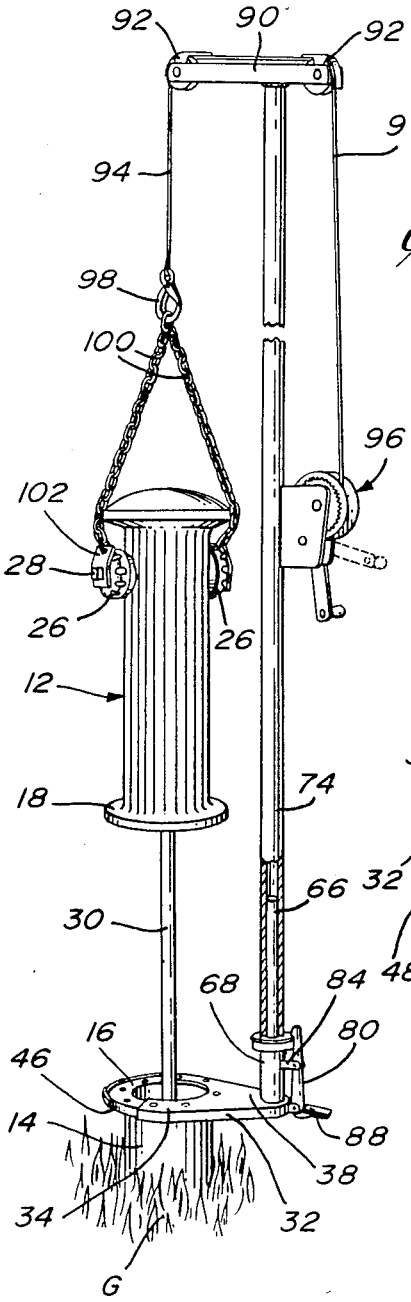
FIG. 1 is a perspective view of the manually-operated hoist of the invention shown supporting a fire hydrant head in elevated position with respect to its underlying feeding pipe.

The hoist of the invention is generally indicated at 10 and is adapted to hoist a fire hydrant head 12 off its supporting feeding pipe 14. The latter normally extends at ground level G, slightly above or below, and is terminated by a top coupling flange 16 adapted to be coupled to the bottom coupling flange 18 of the fire hydrant head 12 by means of bolts and nuts, not shown, extending through registering holes 20, 22 made in the flanges 16 and 18, respectively. The connection between the head 12 and the feeding pipe 14 is normally made leakproof by means of a rubber gasket 24, or the like (see FIG. 4) extending between the two coupling flanges. The presence of sealing gasket 24 normally creates a gap or space between the two coupling flanges 16, 18 when the hydrant head 12 is fixed to the feeding pipe 14. However, in certain cases, such a gap is inexistent.

Fire hydrant heads 12 are normally in the shape of a cylindrical body with lateral water outlets normally closed by screwed caps 26, having a square operating stud 28. From the top of the head body 12 protrudes the top square-shape end of a valve-operating rod 30, the latter extending downwardly through the hydrant head body 12 and feeding pipe 14 to be connected to a fire hydrant operating valve normally set below the ground-freezing level and accessible through the open feeding pipe 14. In certain other types of fire hydrants, the valve-operating rod 30 is made of two sections separable at the junction of the body 12 and feeding pipe, with the top rod section always remaining attached to the fire hydrant head.

Fire hydrant heads often need to be disconnected and hoisted to gain access to the valve and especially to clean the same and to change its gaskets. The hoist of the invention comprises a supporting base, in the form of a semi-circular collar 32 adapted to fit around the top coupling flange 16, said collar having inwardly-directed top and bottom flanges 34, 36, respectively, adapted to overlie the top and bottom faces of the top coupling flange 16. The collar 32 and its flanges 34, 36 form a lateral extension 38 which is symmetrical with respect to the free ends 40 of the collar 32. The top and bottom flanges 34, 36 may be provided with a series of registering holes 42 adapted to register with the holes 20, 22 of the coupling flanges 16, 18. However, it has been found that these holes 42 are not really necessary.

Clamping means are provided to removably clamp the collar 32 around the top coupling flange 16 of the feeding pipe 14. These clamping means includes flexible straps 44, 46, respectively connected at 48, 50 to the respective outer ends 40 of the collar 32, for opening and closing movement in a plane containing the collar; the outer end of straps 44 forms a series of hooks 52 spaced from each other. On the outer end of strap 46, is mounted a toggle lever clamping mechanism including a block 54 pivoted at 56 on lugs 58 fixed to the end of the strap 46. A loop 60 is pivotally carried by the block 54 and is engageable with any selected one of hooks 52 and made to tighten the straps around the coupling flange by operation of a lever handle 62 fixed to block 54. Thus, the collar may be fitted to coupling flanges 16 of different diameters within a certain range. The same effect could be obtained by providing a single hook 52 at the outer end of strap 44 and by mounting the loop 60 on the block 54 with a certain play and by providing a spring biasing the loop 60 to tightening position.

Figure 4:
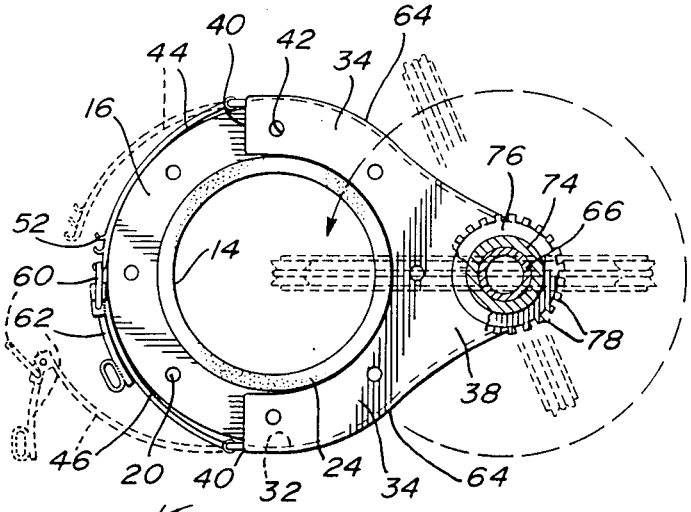
FIG. 4 is a plan section taken along line 4—4 of FIG. 3.

As shown in FIG. 4, it will be noted that the collar 32 does not extend through a full semi-circle; but the wall defined by said collar forms also the wall of the lateral extension 38, so that this wall does not contact the peripheral surface of the coupling flange 16 in the area of the lateral extension. This is to permit fitting the collar to different diameters of coupling flange 16, while obtaining a tight fit.

Figure 2:
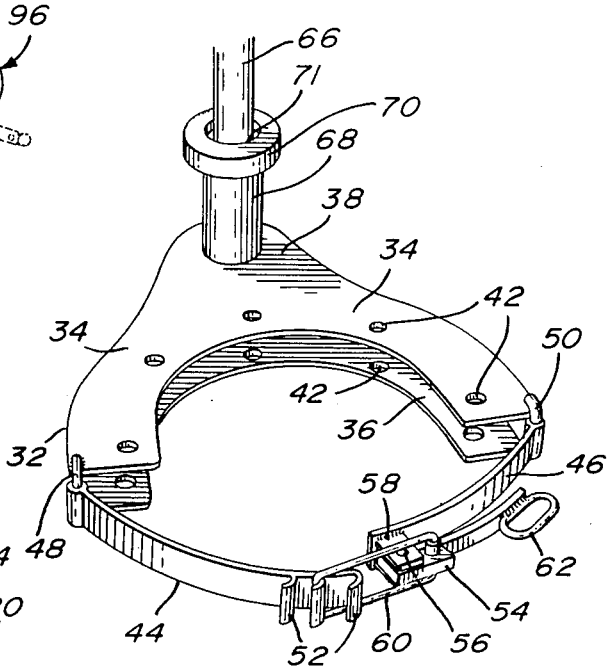
FIG. 2 is a perspective view of the collar portion of the hoist.
Figure 3:
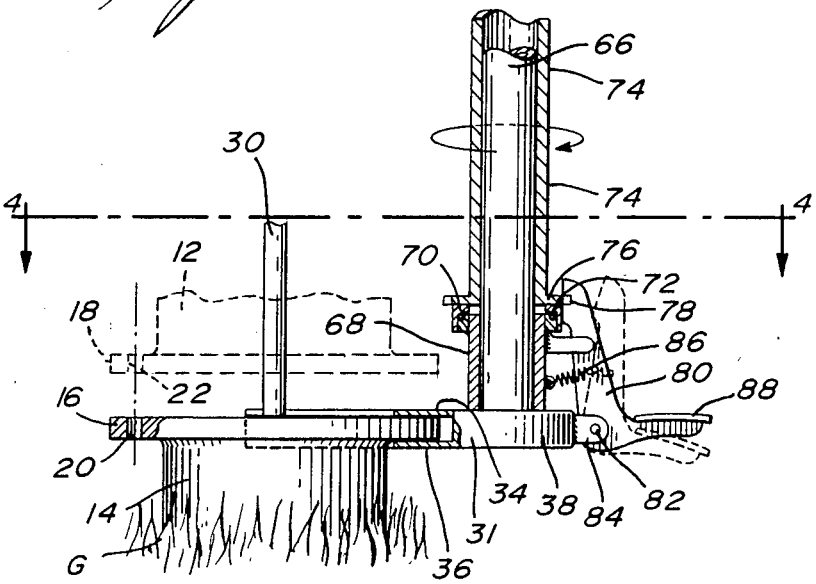
FIG. 3 is a vertical section of the base portion of the hoist shown fitted to the top coupling flange of the fire hydrant feeding pipe.

Referring to FIG. 4, it will be understood that the coupling flange-contacting portions of sectors 64 of the collar 32, and which are diverging in the form of a V-shape, might contact the peripheral edge of the coupling flange at different portions thereof, depending on the diameter of said coupling flange, and yet the collar will be tightly clamped on the coupling flange. A short upright rod 66 is rigidly fixed to the outer end of extension 38 and this rod is surrounded by a sleeve 68, also fixed to lateral extension 38, as shown in FIGS. 2 and 3. The top of the sleeve 68 carries a collar 70 which is radially spaced from rod 66, so as to form an annular cavity 71 for receiving a ball bearing 72. A tubular post 74 is slidably inserted over rod 66 and the lower end of post 74 is provided with a flange 76 which rests on ball bearing 72. Flange 76 is formed with a plurality of radial peripheral notches 78. A catch member 80 is pivoted at 82 to ears 84 protruding from the lateral extension 38. Catch member 80 is adapted to engage anyone of notches 78 under the bias of a tension spring 86, which is attached to the catch member 80 and to the sleeve 68. Catch member 80 has a lateral extension forming a pedal 88 which, when pressed by the operator's foot, clears the notches 78 to allow free pivoting of tubular post 74 about holding rod 66. To the top end of post 74 is fixed a transverse member 90, to the outer ends of which are mounted idle pulleys 92. A cable 94 is trained on pulleys 92. One end of cable 94 is wound on the drum of a conventional manually-operated winch 96, which is mounted on post 74. The outer end of cable 94 carries a safety hook 98, to which may be attached chains 100 adapted to be attached to the studs 28 of the caps 26 of the fire hydrant 12 by means of coupling plates 102. The hoist 10 is installed and used as follows:

The coupling bolts, not shown, which extend through holes 20,22 of the coupling flanges 16,18, are first removed. If there is a gap created by the seal gasket 24 between coupling flanges 16 and 18, then the collar 32 may be immediately fitted to the top coupling flange 16 of the feeding pipe 14 and clamped in position by clamping straps 44, 46 and toggle lever 60, 62. This is possible, since the upper flange 34 of collar 32 will be inserted within said gap and will fit just around the gasket 24, as shown in FIG. 4.

If there is no such gap with the coupling flanges 16, 18 directly abutting each other, then it is a simple matter to manually tilt the hydrant head 12 on the pipe 14, so as to provide the proper clearance for the insertion and fitting of the collar 32 on the coupling flange 16. The hydrant head 12 is then attached to the cable winch arrangement by means of the coupling plates 102 and lifted to a certain extent by operation of the winch 96. At this point, bolts can be fitted through the registering holes 52 and 20 to more positivley secure the collar to the top coupling flange 16, if so desired. However, this has not been found to be necessary, since the top and bottom flanges 34, 36 of collar 32, which slidably engages the top and bottom surfaces of the coupling flange 16, positively retain the collar in horizontal position, despite the leverage effect exerted on the collar by the weight of the hydrant head 12, and this will hold true irrespective of the rotated position of the post 74 with respect to the base collar 32. The hydrant head 12 can be hoisted and then swung to one side or the other of the feeding pipe 14 by first releasing the pedal-operated catch member 80. Although several notches 78 have been shown, in practice, there is need only for four notches 78 spaced 90 degrees from each other.

Once the fire hydrant head 12 is out of the way, the inside of feeding pipe 14 becomes readily accessible for repairs of the hydrant valve. The hydrant head 12 is replaced in position on the feeding pipe 14 and can be properly easily oriented, so as to register the holes 20, 22.

If the seal gasket 24 provides a gap as above noted, the collar 32 can be removed once the head 12 is squarely resting on the pipe 14; otherwise, the former will have to be slightly tilted. The hoist 10 is easily dismantled and is of minimum weight for manual transport. Because the hoist is directly attached to the feeding pipe 14, its post 74 will always be vertical when in operating position and any lawn surrounding the pipe 14 will not be damaged.

What I claim is:

1. A hoist for hoisting a fire hydrant head off its underlying upright feeding pipe, the latter having a top coupling flange, said hoist comprising a post, a lateral arm carried by the top of said post, fire hydrant hoisting means carried by said post and arm and a base for supporting said post in upright position, said base including a generally semi-circular collar for partly surrounding the peripheral face of said feeding pipe top coupling flange, clamping means to removably clamp said collar in operative position on said top coupling flange, said collar having inwardly-extending upper and lower flanges for overlying and underlying said top coupling flange, said collar having a lateral extension, said post upstanding from said lateral extension to clear said hydrant head, and means to rotate said arm about the axis of said post.

2. A hoist as defined in claim 1, wherein said collar includes two portions symmetrically diverging from said lateral extension and engageable with only a portion of the periphery of said top coupling flange, said clamping means including flexible straps pivotally attached to the respective outer ends of said collar for movement in the plane of said collar, and hooking means at the outer ends of said straps for clamping said straps around the periphery of said coupling flange, said straps having effective length- adjusting means whereby said collar can be fixed to coupling flanges of a predetermined range of diameters.

3. A hoist as defined in claim 2, wherein said lateral arm is fixed to the top of said post and the lower end of said post is rotatably mounted on said lateral extension.

4. A hoist as defined in claim 3, wherein said post is tubular and further including an upright stud fixed upright to said base extension and engageable within said post, a sleeve surrounding said stud and fixed to said lateral extension, said stud protruding upwardly from said sleeve, a collar fixed to the upper end of said sleeve and spacedly surrounding said stud to define an annular recess, a ball bearing mounted in said recess, the lower end of said post resting on said ball bearing.

5. A hoist as defined in claim 4, further including a latching mechanism to removably latch said post in selected rotated positions with respect to said lateral extension.

6. A hoist as defined in claim 5, wherein said latching mechanism includes a flange fixed to the lower end of said post and radially outwardly protruding from said sleeve collar, said flange having angularly-spaced notches, and a spring-biased pedal-operated latching lever pivoted on said lateral extension and engageable with any one of said notches under the bias of its spring.

* * * * *